US005899050A

United States Patent [19]

Bergwerf

[11] Patent Number: 5,899,050

[45] Date of Patent: May 4, 1999

[54] METHOD AND APPARATUS FOR FILLING AND CLOSING ENVELOPES

[75] Inventor: Willem Coenraad Bergwerf, Drachten, Netherlands

[73] Assignee: Hadewe B.V., Drachten, Netherlands

[21] Appl. No.: 08/910,204

[22] Filed: Aug. 13, 1997

[30] Foreign Application Priority Data

Aug. 13, 1996 [NL] Netherlands ..... 1003796

[51] Int. Cl.[6] ..... B43M 5/04; B65B 5/04; B65B 57/02

[52] U.S. Cl. ..... 53/460; 53/69; 53/76; 53/284.3; 493/23; 493/245

[58] Field of Search ..... 53/460, 284.3, 53/55, 69, 76, 75, 505, 64, 67, 382.2, 381.5, 377.6; 493/23, 245, 453

[56] References Cited

U.S. PATENT DOCUMENTS

| | | | |
|---|---|---|---|
| 4,418,515 | 12/1983 | Foster et al. | 53/460 X |
| 4,903,456 | 2/1990 | Meur | 53/69 |
| 4,924,652 | 5/1990 | Krasuski et al. | 53/55 |
| 5,125,214 | 6/1992 | Orsinger et al. | 53/460 |
| 5,152,122 | 10/1992 | DeBarber et al. | 53/284.3 X |
| 5,251,425 | 10/1993 | Kern | 53/460 |
| 5,414,977 | 5/1995 | Cohen | 53/381.5 X |

FOREIGN PATENT DOCUMENTS

| | | |
|---|---|---|
| 0 317 932 | 5/1989 | European Pat. Off. . |
| 0 352 692 | 1/1990 | European Pat. Off. . |
| 0 352 693 | 1/1990 | European Pat. Off. . |
| 2 284 794 | 6/1995 | United Kingdom . |

*Primary Examiner*—James F. Coan
*Attorney, Agent, or Firm*—Burns, Doane, Swecker & Mathis, L.L.P.

[57] ABSTRACT

Enveloping apparatus with an envelope filling position (4) and, extending therefrom, an envelope transfer track (46) extending along a closing nip (49) beside the envelope transfer track (46). Beyond the closing nip (49) the envelope transfer track (46) comprises opposite surfaces and a brake, blocking or drive mechanism (60) for at least delaying movement in direction of transport of those surfaces. The control structure (43, 61, 72) is adapted to activate an upsetting feature (55, 56, 71) in response to a displacement of that envelope (5) from the envelope filling position (4) through a fixed, specific distance. With the opposite surfaces with a nip thereinbetween, movement in direction of transport of envelopes with the leading edge in different positions can be delayed, stopped or reversed, without requiring adjusting a stop or the like. There is also described a method for filling and closing envelopes.

13 Claims, 3 Drawing Sheets

METHOD AND APPARATUS FOR FILLING AND CLOSING ENVELOPES

The invention relates to an enveloping apparatus with an envelope filling position, a document inserting structure, an envelope transfer track extending from the envelope filling position, a pair of pressure rollers with an interlocated closing nip at a distance from the envelope filling position, upsetting means and a control structure for controlling the document inserting structure and the envelope transfer track.

The invention also relates to a method for filling and closing an envelope with a flap substantially extending in one plane, an envelope body and an interlocated hinge line, wherein the envelope is held in an envelope filling position with the flap in opened condition, at least one document is fed to the envelope in the envelope filling position and inserted in the envelope, the filled envelope is moved along an envelope transfer track in a direction transverse to the hinge line and substantially in the plane of that envelope, in a part of the envelope transfer track downstream of a closing nip located on the side of the envelope transfer track a leading portion of the envelope is stopped, so that the hinge line deflects from the envelope transfer track towards the closing nip and passes through the closing nip in the leading position.

Such apparatus using, in operation, such a method are commercially available under the type name of IN-2A and IN-2B. These known apparatus are provided with a stop at a distance downstream of the closing nip for stopping a leading portion of an envelope and thus deflecting the fold between the flap and the envelope body. The position of this stop relative to the closing nip should be adjusted in conformity with the height of the envelope body of the envelopes to be processed, measured from the foot of the envelope to the fold between the flap and the envelope body. Adjusting the stop takes time and involves the risk of incorrect adjustment. The necessity of adjusting the stop further makes it impossible to process without intermediate adjustment envelopes having different heights measured from the foot of the envelope to the fold between the flap and the envelope body.

U.S. Pat. No. 4,924,652 and European patent application 0 352 693 disclose apparatus for closing filled envelopes. A filled envelope with a trailing flap is fed via an inlet and moved along a conveyor track connecting to that inlet. In this apparatus not only the leading portion of the envelope, but also the rest of the envelope is stopped after the filled envelope has reached a specific position with the flap at the height of a pair of closing rollers. Subsequently, the pair of rollers is moved so as to slightly fold the flap in the closing direction, and the envelope is fed between the pressure rollers against the direction of transport, wherein the flap is completely closed and pressed down. After the flap has thus been closed and pressed down, the envelope is further conveyed to the outlet of the apparatus.

Such arrangements, however, are less suitable for apparatus having a great processing capacity, because the average feed-through velocity of the envelopes is reduced as a result of the temporary movement of the envelopes against the direction of transport. Besides, the envelopes must be conveyed over a relatively large distance against the direction of transport so as to also completely press down the longest flaps occurring.

SUMMARY OF THE INVENTION

The object of the invention is to provide an apparatus and a method, wherein the envelopes having different lengths are automatically at least delayed when these envelopes have reached a specific position relative to a closing nip for closing the flap, but wherein the processing capacity is not limited by each temporary movement of the complete envelope against the original direction of transport.

According to the present invention, this object is attained by providing an apparatus for closing and filling an envelope of the initially described type, wherein the control structure is adapted to determine a distance over which an envelope is moved from the envelope filling position along the envelope transfer track, the upsetting means comprise a pair of surfaces located opposite each other on both sides of the envelope transfer track, with an interlocated nip and means coupled to at least one of those surfaces for at least delaying, in activated condition, movement in the direction of transport of those surfaces in the region of the nip, and the control structure is adapted to activate the upsetting means in response to a movement of the envelope from the envelope filling position along the envelope transfer track over a fixed determined distance, independently of the sizes in the direction of transport of the envelope to be closed.

The invention may also be used by feeding in a method of the initially described type the leading portion of the envelope to be closed into a nip between surfaces located opposite each other and at least delaying it in response to a movement of the envelope to be closed along the envelope transfer track over a fixed distance from the envelope filling position, which distance is independent of the length of the above envelope, and carrying out the at least delaying of the leading portion of the envelope to be closed by means of the surfaces on both sides of the nip into which the leading portion of the envelope is fed.

As the upsetting means for delaying, stopping or moving back a leading portion relative to a trailing portion of an envelope to be closed, are provided with a pair of surfaces located on both sides of the envelope transfer track, which surfaces have a nip therebetween, envelopes with the leading edge in different positions can be caused to deflect without the necessity of adjusting a stop or the like. In this manner, different envelopes can be processed in succession without time being lost in adjusting a stop or the like.

Because the control system is adapted to operate the surfaces for at least delaying therebetween a leading portion of an envelope in response to the completion of a displacement of that envelope along the envelope transfer track through a fixed distance from the filling position, envelopes of different dimensions can automatically be upset with the hinge line, which cannot be detected or only with utmost difficulty, between the flap and the envelope body in a fixed region adjacent the closing nip. After deflection of the envelope after the hinge line has reached the desired region before the closing nip, the envelope can readily be fed, with the hinge line in leading position, through the closing nip, whereby the flap is closed and pressed down so that this flap, in the area where it is provided with adhesive, is glued against the envelope body.

As a matter of fact, the length between the leading or trailing edge of the envelope and the hinge line along the flap is in many cases known, because this information is used for bringing the envelope into the filling position. The same information can be used again for displacing the envelope along the envelope transfer track so as to guarantee, by scanning the leading or trailing edge of that envelope, that it is displaced from the filling position over a fixed distance before the leading portion thereof is delayed, stopped or forced back.

A further advantage of the present invention is that a track leading to an alternative outlet can also be connected to the upsetting means, and that envelopes fed to that alternative outlet are not closed.

Particular embodiments of the present invention are described in the following description and the subclaims.

Hereinafter, the invention will be further illustrated and explained on the basis of an exemplary embodiment that is most preferred at this moment, with reference to the accompanying drawings.

DESCRIPTION OF THE PREFERRED EMBODIMENTS

Figure 1:
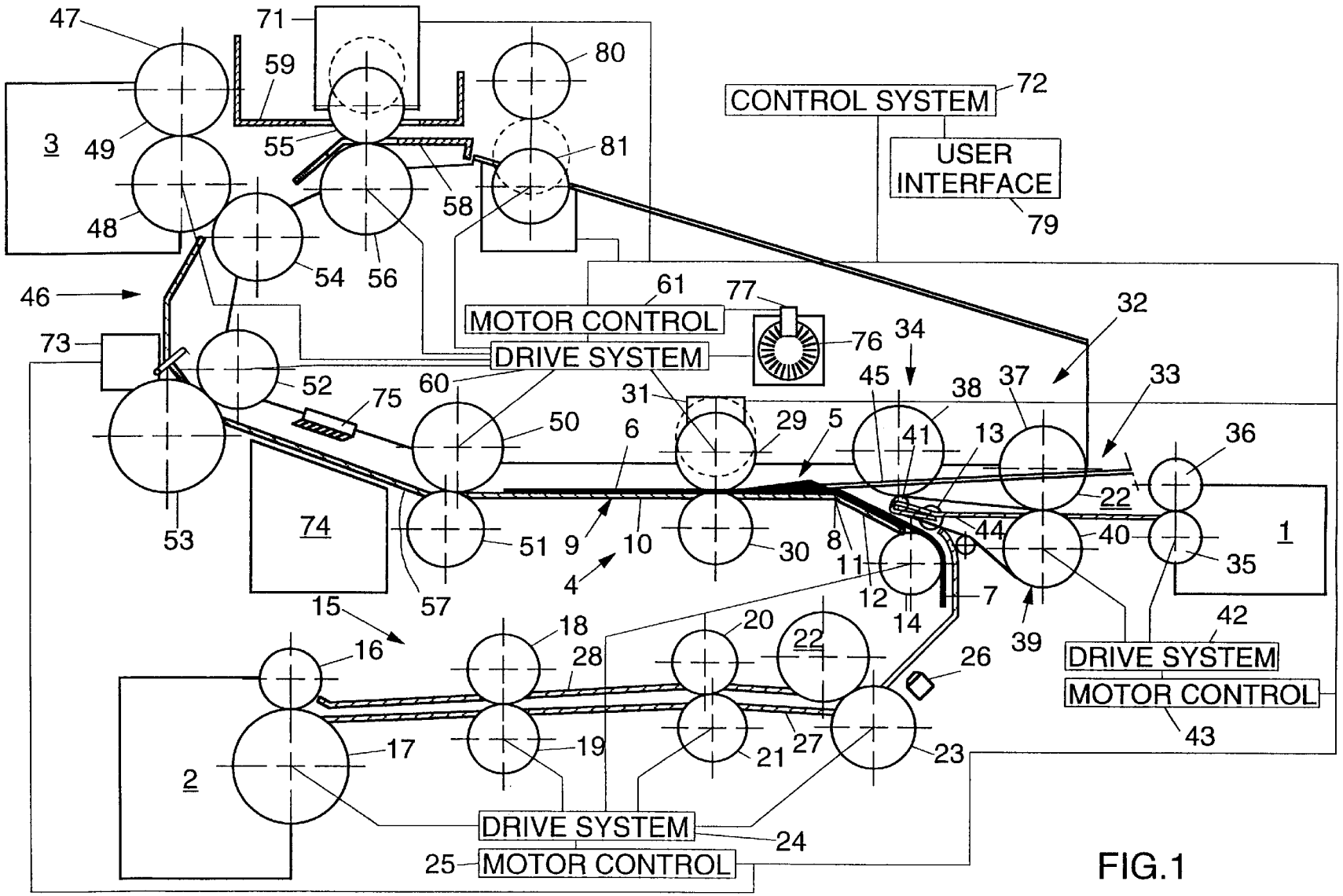
FIG. 1 is a schematized representation in side view of an apparatus according to the invention.

The apparatus according to the example shown in the drawings comprises a holder 1 for documents to be packed, a holder 2 for envelopes and a holder 3 for storing filled envelopes. The holders 1, 2 for documents to be packed and for envelopes each comprise a separator for dispensing, piece by piece, documents respectively envelopes. Such holders are known in different types to a skilled person and are for that reason not further described here. The general lay-out of the apparatus shown corresponds to an enveloping station that is commercially available under the type indication Neopost IN-2A. Therefore, the housing, drive mechanisms, couplings, etc. are not described in detail.

In the apparatus according to the example shown, an envelope filling position 4 is adapted for in each case holding an envelope. In the apparatus a shown in FIG. 1, an envelope 5 with an envelope body 6, a flap 7 and a hinge line 8 between the envelope body 6 and the flap 7 is in the filling position 4. The envelope body 6 is carried by an envelope carrier 9 having a supporting surface 10 extending from an upstream edge 11. An upstream portion of the envelope carrier 9 is formed by an inclined guide plate 12 connecting at an angle along the upstream edge 11 to the supporting surface 10. The flap 7 of the envelope 5 in the filling position 4 is held between a pair of rollers 13, 14.

These rollers 13, 14 also form the extreme downstream rollers of an envelope feed track 15 extending from the envelope holder 2 to the envelope filling position 4. The portion of the envelope feed track 15 located upstream of these rollers 13, 14 is formed by four further pairs of conveyor rollers 16, 17, 18, 19, 20, 21 and 22, 23. Of each pair of rollers along the envelope feed track 15, one is in each case connected to a drive system 24 which is also known per se and hence only shown schematically in the drawing. The drive system 24 is coupled to a motor control 25. Provided along the envelope feed track 15 is a detector 26 for detecting, depending on the control system selected, the leading and/or trailing end edge of an envelope passing along the envelope feed track 15. Further, the envelope feed track 15 is formed by guide plates 27, 18.

Suspended opposite each other on either side of the envelope carrier 9 are two conveyor rollers 29, 30, of which the upper conveyor roller 29 is displaceable, by means of an electromagnetic operating unit 31, between a position against the lower roller 30, shown in full lines, and a position spaced from the lower roller 30, shown in broken lines. When the upper roller 29 is held in its lifted position, an envelope can readily be brought into the filling position 4 and the insertion of documents into the envelope 5 in the filling position 4 is not obstructed by external pressure exerted on the envelope.

In operation, it is known, after the detection of the leading edge or the trailing edge of an envelope at the location of the detector 26 along the envelope feed track 15, partly on the basis of the inputted data concerning the distance of that leading or trailing end edge to the hinge line of that envelope, through what distance the detected envelope should be further conveyed in order to bring it into a position with its hinge line directly above the upstream edge 11 of the supporting surface 10. If the trailing end edge is detected, the distance that is still to be travelled at the moment of detection is for instance equal to the difference between, firstly, the distance along the envelope feed track 15 from the detector 26 to the upstream edge 11 of the supporting surface 10, and, secondly, the distance from the trailing edge to the hinge line of the passing envelope.

After detection of the leading or the trailing end edge of the passing envelope, the roller 14, controlled by the motor control 25, is rotated through an angular displacement which, taking into account the unroll circumference of the roller 14, corresponds to the distance through which that envelope is still to be displaced. In this manner, each envelope is accurately positioned with the hinge line 8 above the upstream edge 11 of the supporting surface 10. The guides of the filling position 4 upstream of the supporting surface 10 are oriented so that the flap 7, after the envelope 5 has reached the intended position in the filling position 4, is held in an open position relative to the envelope body 6.

The apparatus further comprises a document inserting structure 32 composed of a document feed track 33 extending from the document holder 1 to the filling position 4 and an insertion guide 34 for inserting fed documents into an envelope 5 in the envelope filling position 4.

The feed track 33 is formed by a pair of rollers 35, 36 and by an assembly of a pair of upper rollers 37, 38 and, opposite thereto, a lower, circuitous belt conveyor 39 having rollers 40 and 41. Two of the rollers 35, 40 of the document feed track 33 are coupled to a drive system 42, which in turn is controllable by a motor control 43 connected thereto. The insertion guide 34 is composed of a lower guide 44 which, moreover, in each case keeps the flap 12 of the envelope 5 free from the belt conveyor 39, and of an insertion finger 45 movable back and forth between a projecting position, as shown, for in each case providing space in an envelope 5 that is held ready, and a withdrawn position, not shown. An enveloping machine having a document feed track comprising a belt conveyor on the side of the document feed track where the flap of the envelope is held open is described in more detail in applicant's Dutch patent application 1002001.

From the envelope filling position 4, an envelope transfer track 46 extends beyond a pair of pressure rollers 47, 48 with an interlocated closing nip 49 at a distance from the envelope filling position 4 and besides the envelope transfer track 46. These parts of the apparatus are moreover shown in a larger and more schematic view in FIGS. 2 and 3. The envelope transfer track 46 is formed by four pairs of rollers 50, 51; 52, 53; 48, 54 and 55, 56, and by guides 57, 58, 59. One of the rollers of the envelope transfer track 46 also constitutes the pressure roller 48 of the closing nip 49. Of each roller pair, one roller is in each case coupled to a drive system 60 which is in turn coupled to and controllable by a motor control 61. One of the conveyor rollers on both sides of the envelope filling position 4 is likewise coupled to the drive system 60 of the envelope transfer track 46.

The holder 3 for storing filled envelopes is arranged downstream of the closing nip 49 in such a manner that filled and closed envelopes are collected in that holder 3.

Figure 2:
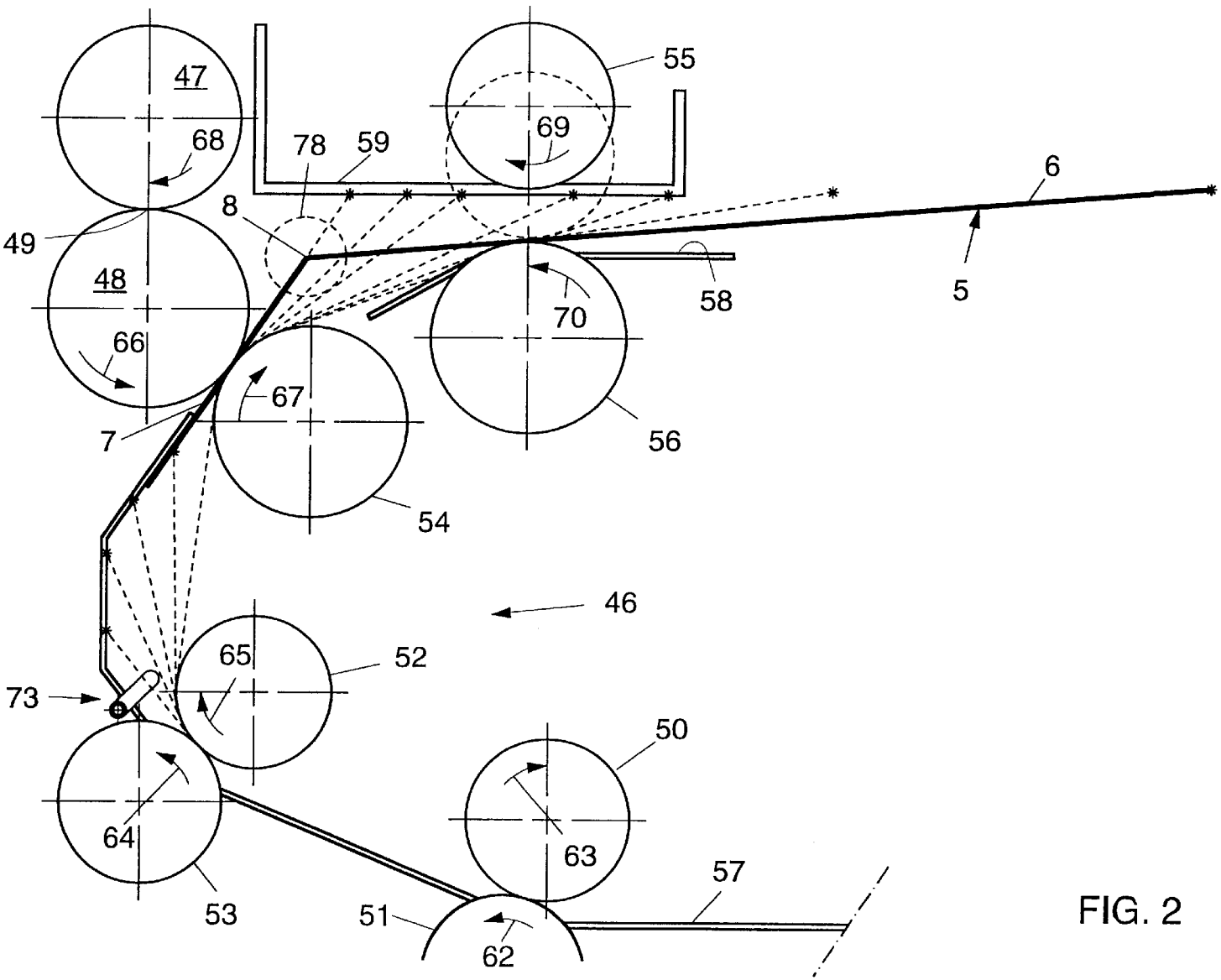
FIGS. 2 and 3 are further schematized representations of a portion of the apparatus according to FIG. 1 in successive operating conditions.
Figure 3:
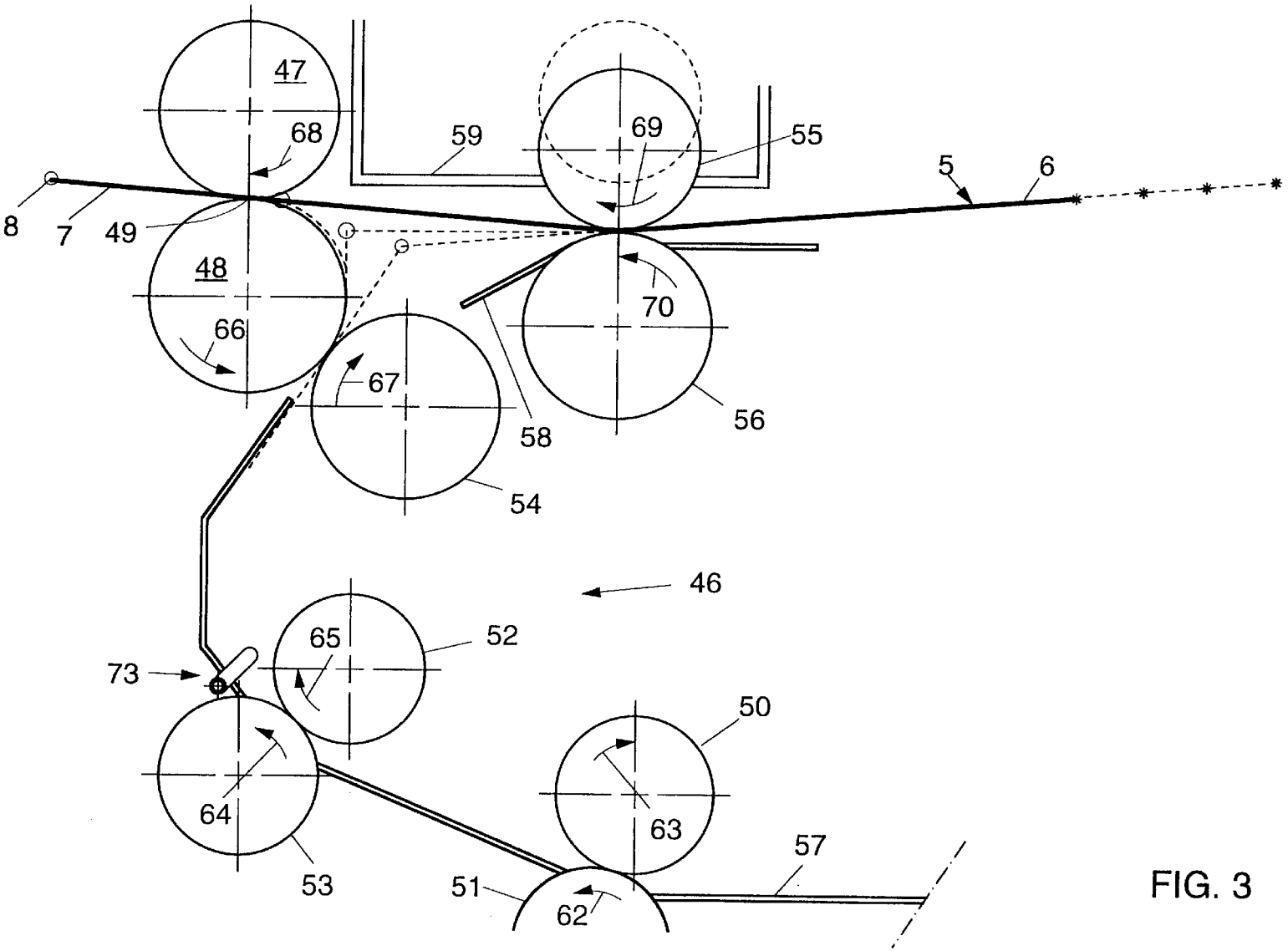

By means of a control unit 71, the upper roller 55 of the extreme downstream pair of rollers 55, 56 can be moved back and forth by an electromagnet between a position abutting against the lower roller 56 (FIGS. 1 and 3) and a position spaced from the lower roller 56 (FIG. 2). Further, the driven roller 56 of the extreme downstream pair of rollers 55, 56 is coupled to the drive system in such a manner that, in operation, it rotates in a sense of rotation opposite to the sense of rotation of the more upstream rollers 50, 52 and 54 on the same side of the envelope transfer track 46. The sense of rotation of the rollers 47, 40 and 50–56 in FIGS. 2 and 3 is indicated by arrows 62–70.

The rollers 55, 56 located at a distance downstream of the closing nip 49 constitute, together with the control unit 71 for lifting the upper roller 55, an assembly for reversing the direction of travel of a leading portion of an envelope in the envelope transfer track 46 relative to a trailing portion, which is propelled further by the rollers 52, 53 and 48, 54 located upstream of the closing nip 49.

The motor controls 25, 43, 61 of the envelope feed track 15, the document inserting structure 32, the envelope transfer track 46, the pressure roller 48 and the roller 29 opposite the envelope carrier 9 are coupled to a control system 72 and thus form a control structure for controlling the envelope feed track 15, the document inserting structure 32, the envelope transfer track 46, the pressure roller 48 and the roller 29.

Provided along the envelope transfer track 46 at a distance upstream of the closing nip 49 is an envelope detector 73 which, in response to the passing of an end edge of an envelope which edge is directed transversely to the envelope transfer track 46, applies a signal to the control system 72 that is also connected to that envelope detector 73.

There is further provided along the envelope transfer track 46 a wetting unit consisting of a reservoir 74 and an applicator 75. Such wetting unit is known per se.

The control system 72 and the motor control 61 of the envelope transfer track 46, the rollers 29, 30 of the filling position 4 and the pressure rollers 47, 48 are adapted to determine the distance through which an envelope has been displaced from the filling position 4 along the envelope transfer track 46. For this purpose, the drive system 60 of the envelope transfer track 46, of the rollers 29, 30 and of the pressure rollers 47, 48 is also coupled to a pulse disk 76 whose angular displacement is always proportional to the angular displacement of the rollers 29, 30, 48, 49 and 50–56. The rollers 29, 30, 48, 49 and 50–54 which convey the envelopes to and along the envelope transfer track 46 are moreover coupled in such a manner that they are always driven at mutually identical peripheral velocities. As a result, the angular displacement of the pulse disk 76 is always proportional to the displacement of an envelope along the envelope transfer track 46. Provided next to the pulse disk 76 is a detector 77 coupled to the motor control 61 of, inter alia, the envelope transfer track 46 for observing the angular displacement of the pulse disk 76 to that motor control 61.

The control system 72, the motor control 61 and the operating unit 71 for varying the distance between the rollers 55, 56 downstream of the closing nip 49 are adapted to operate the operating unit 71 for displacing the rollers 55, 56 towards each other in response to a displacement of that envelope from the filling position along the envelope transfer track through a specific, fixed distance, independently of the sizes in the direction of transport of that envelope.

The driven rollers 48, 50 and 52 which partly define the envelope transfer track 46 upstream of the closing nip 49 are intercoupled without slip. It is thus guaranteed in a simple manner that the peripheral velocity and the unroll distance of the different rollers 48, 50–54 that define the envelope transfer track 46 upstream of the closing nip 49 during the conveyance of an envelope along the envelope transfer track always remain equal relative to one another.

In operation, an envelope 5 is moved in the position shown in FIG. 1, with the hinge line 8 between the flap 7 and the envelope body, from the envelope holder into the envelope filling position 4 and retained in that position, with the flap 7 between the rollers 13 and 14 being held in open position relative to the envelope body 6. Then, in a manner known per se, at least one document is fed to the envelope 5 in the envelope filling position 4 and inserted into the envelope 5.

After having been filled, the envelope 5 is displaced in a direction transverse to the hinge line 8 and approximately in the plane of the envelope 5, along an envelope transfer track 46, as shown in FIG. 2. Intermediate positions of the envelope body 5 during the conveyance are shown in FIG. 2 in broken lines, the position of the leading edge each time marked *. The position shown in full lines in FIG. 2 is realized after the completion of a displacement through a predetermined, fixed distance from the filling position 4, where the envelope with the hinge line 8 between the flap 7 and the envelope body 6 is retained in a predetermined position. In the position shown in FIG. 2, the hinge line 8 between the flap 7 and the envelope body 6 is located in a predetermined region 78 adjacent the closing nip 49.

Both the position of the upstream edge 11 of the supporting surface 10 whence the hinge line 8 departs during conveyance along the envelope transfer track, and the position of the region 78 which the hinge line 8 should reach before the envelope 5 is caused to deflect, are fixed. As a result, for all envelopes that can be processed by the apparatus, regardless of the sizes of those envelopes, a displacement through the same, fixed distance results in the hinge line 8 being moved into the intended region 78 before the closing nip 49.

In response to the completion of the displacement of the envelope 5 along the envelope transfer track 46 through the predetermined, fixed distance, the operating unit 71 for varying the distance between the rollers 55, 56 is operated for displacing the upper roller 55 from the position spaced from the lower roller 56 shown in FIG. 2, to the position against the lower roller 56 shown in FIG. 3. Since the lower roller 56 is driven against the direction of transport of the envelope 5 (arrow 70), the direction of travel of a leading portion 6 of the envelope 5 in the envelope transfer track 46 is reversed. Further, the other rollers 48 and 50–54 of the envelope transfer track 46 upstream of the closing nip 49 are further driven in the direction of transport, whereby a trailing portion 5 of the envelope 5 located in a portion of the envelope transfer track 46 upstream of the closing nip 49 is further conveyed in the direction of transport. This causes the hinge line 8 to deflect from the envelope transfer track 46 towards the closing nip 49. Successive stages of the deflecting of the envelope are shown in FIG. 3 in broken lines, wherein successive positions of the hinge line 8 are marked °, while successive positions of the original leading end edge of the envelope 5 are again marked *.

According as the envelope 5 deflects further, the hinge line 8 approaches the closing nip 49. Finally, the rollers 47, 48 entrain the hinge line 8 of the envelope 5 and the envelope 5 is conveyed through the folding nip, as shown in FIG. 3. This involves the envelope being passed through the closing nip 49 besides the envelope transfer track 46, with the hinge line 8 in leading position. After the envelope 5 has passed the closing nip, it is introduced into the holder 3 for filled and closed envelopes as the rollers 47, 48 and 50–56 along the envelope transfer track 46 and on both sides of the closing nip 49 are further rotated in the directions indicated by the arrows 62–70.

In the holder 3, the filled and closed envelopes are collected. Through optional activation of the wetting means 75, the envelopes can be optionally sealed up.

In the apparatus according to the example shown, wherein during the conveyance of an envelope along the envelope transfer track 46 the peripheral velocities of the rollers 29, 30, 48, 50–54 of the filling position 4 and the envelope transfer track 46 are in each case equal, and hence the products of the angular displacement and the unroll circumference 29, 30, 48, 50–54 are always mutually equal, the direction of movement of the leading portion of the envelope 5 is reversed in response to one of the rollers reaching a fixed angular displacement corresponding for that roller to the fixed, predetermined distance. Thus, the operation of the operating unit 71 for varying the distance between the rollers 55, 56 can always be carried out in response to the same data registered, regardless of the sizes of the envelope that is processed, which simplifies the control of the apparatus.

As measure for the unrolling distance of the rollers along the envelope transfer track 46 upstream of the closing nip 49, in response to which unrolling distance the operating unit 71 for varying the distance between the rollers 55, 56 should be operated for displacing the upper roller towards the lower roller 55, 56, the angular displacement of the pulse disk 76 is used which is proportional to the rotation of the rollers along the envelope transfer track 46 and of the rollers 29, 30 of the envelope filling position. This angular displacement is registered by the motor control 61 by means of the detector 77. When the value corresponding to the predetermined fixed unrolling distance has been reached, a signal is provided to the control system 72, which, in response thereto, sends a command to the operating unit 71 for lifting the upper roller 55 from the lower roller 56. In that case, the envelope detector 73 can for instance be used for detecting the trailing end edge of a passing envelope so as to determine when a next envelope can be conveyed along the envelope transfer track 46.

As one of the rollers 55, 56 that are located downstream of the closing nip 49 along the envelope transfer track 46, can be moved back and forth, relative to the other ones of those rollers 55, 56, between a run-in position spaced from that other roller 56 and an upsetting position against that other roller 56, the leading part of the envelope can easily run in between those rollers 55, 56 and the drive of the roller 56 against the direction of transport of the arriving envelopes, as indicated by the arrows 70, during the running in of an arriving envelope between those rollers 55, 56, need not be interrupted. The roller 56 may or may not be driven continuously. If, instead of one of the rollers 55, 56 located downstream of the closing nip 49 along the envelope transfer track 46, those two rollers 55, 56 are driven both, the advantage of a simple control of the drive of those rollers holds for the drive of both two rollers 55, 56.

For obtaining a drive system 60 of a simple construction, it is advantageous if the drive of the rollers 55, 56 located downstream of the closing nip 49 along the envelope transfer track 46 is coupled to the drive of the rollers 48, 50, 52 located upstream of the closing nip 49 along the envelope transfer track 46.

Alternatively, the envelope transfer track 46 and the control system 72, in combination with the motor control 61, can also be designed for detecting the displacement of an envelope prior to detection of an end edge transverse to the envelope transfer track and for determining the further displacement of the detected envelope after detection of this end edge in such a manner, that the sum of the displacements before and after detection of this end edge corresponds to the predetermined displacement from the filling position in response to which the leading part of the envelope should be stopped and fed back.

When a thus designed envelope-filling and closing machine according to the invention is used, an end edge of the envelope which edge is directed transversely to the envelope transfer track 46 is detected when it passes the envelope detector 73 and the displacement of the envelope completed priorly to the detection of the relevant end edge is determined. Then, after detection, the envelope is further displaced through a distance equal to the difference between (1) the fixed length of the track along the envelope transfer track 46 between the upstream edge 11 of the supporting surface 10 and the region 78 before the closing nip 49, and (2) the displacement of the envelope from the filling position 4, or from a position at a fixed distance from the filling position, to the detection of the end edge of the envelope. The sum of the displacements before and after detection is hence always equal to the fixed distance through which each envelope is to be moved from the filling position in order to move the hinge line 8 thereof in the intended region 78 before the closing nip 49.

As a further alternative, the apparatus shown may also comprise a user interface 79 or a communication gate and a memory for inputting and registering, for specific types of envelopes to be processed, values that each correspond to the distance in direction of transport between the hinge line and one of the end edges for the relevant type of envelope. The envelope transfer track 46, the envelope detector, the control system 72 and the motor control 61 are preferably adapted to determine the further displacement of an envelope after detection of one of the end edges thereof from, in the first place, the distance in direction of transport between the hinge line and one of the end edges for the relevant type of envelope, and, in the second place, the distance along the envelope transfer track between the envelope detector and the region 78 of the envelope transfer track 46 before the closing nip 49 where the hinge line 8 should be caused to deflect.

Downstream of the roller pair 55, 56 for stopping and feeding back a leading portion of an envelope, a further pair of rollers 80, 81 is provided, of which one roller 81 is movable back and forth between a position against the other roller 80 indicated in dotted lines, and a position spaced from the opposite roller 80 indicated in full lines.

The reciprocable roller 81 is coupled to the drive system 60 in such a manner that, in operation, it rotates in downstream direction (away from the closing nip 49).

By pressing the rollers 80, 81 against each other and keeping the rollers 55, 56 of the assembly for stopping and conveying backwards a leading portion of an envelope spaced apart, an envelope can, instead of being deflected towards the closing gap 49, be conveyed further by the rollers 80, 81 to a depositing position (not shown). In this manner, envelopes that should not or not yet be closed can be separated in a simple manner.

This possibility can for instance be used for diverting envelopes whose flaps are not open and which could hence not be filled in the filling position. Another possibility is diverting envelopes which have been processed as a test and which should not be forwarded. Further, envelopes whose thickness or weight does not correspond to the intended contents can automatically be separated. A further possibility is the selective diversion of envelopes on the basis of signs read from those envelopes or processing instructions associated with those envelopes.

It will be appreciated that the automatic selective diversion of envelopes can also be realized with various other means. Instead of adding a pair of rollers downstream of the rollers 55, 56 for stopping and conveying back a leading envelope portion, it may also be provided that at least one of the conveying elements 55, 56 can selectively be driven in two opposite directions. If the distance to the depositing position is not too large, and in particular if the diversion track extends downwards, for diverting envelopes, the drive by the conveying elements 48, 54 upstream of the conveying elements 55, 56 for stopping and conveying back a leading envelope portion may also suffice.

When a filling and closing machine according to the present example is used, before envelopes of a specific type are processed, a value corresponding to the distance in the direction of transport between the hinge line and the end edge to be detected of such envelope is inputted and registered.

In operation, the end edge of each envelope that is processed is detected when passing the envelope detector 73 along the envelope transfer track 46. The distance of the further displacement of the envelope after detection, in response to which further displacement the leading portion of the envelope should at least be delayed, is determined from, in the first place, the registered distance in the direction of transport between the hinge line and the end edge to be detected and, in the second place, the distance along the envelope transfer track between the envelope detector 73 and the region 78 of the envelope transfer track 46 before the closing nip 49. Finally, in response to the completion of the displacement through the determined further distance, the direction of transport of the leading portion of the detected envelope is reversed, so that the hinge line between the flap and the envelope body in the region 78 of the envelope transfer track 46 before the closing nip 49 (i.e. after completion of the fixed, predetermined total displacement from the filling position 4) is caused to deflect.

This manner of determining the fixed total displacement of each envelope from the filling position 4 in response to which the deflection is initiated, offers the advantage that any slip between the rollers 29, 30 of the filling position 4 and between rollers 50–52 of the envelope transfer track 46 upstream of the envelope detector 73, as well as variations in unrolling circumference of the driven rollers upstream of the envelope detector 73, is compensated. In many cases, the inputting and registering of the value corresponding to the distance between one of the end edges and the hinge line of each envelope of a specific type does not involve any additional operations and communication, because in many cases, this value has to be inputted anyhow to enable the envelope to be brought in the intended place in the filling position 4.

After the foregoing, it will be understood by anyone skilled in the art that within the framework of the invention, many other embodiments and methods of construction are possible. Particularly for the table-model filling and closing machines, if may for instance be preferred that the envelope be manually brought into the filling position by the user.

Instead of reversing the direction of movement of a leading portion of the envelope downstream of the closing nip, it is also possible to only stop or delay the leading portion. For this purpose, the rollers downstream of the closing nip may for instance be provided with a freewheel clutch allowing free rotation against the direction of transport (i.e. in the direction of the arrows 69, 70). The upsetting of the envelope can then for instance be effected by delaying it to a suitable degree from the moment that the envelope has been displaced from the filling position through a specific distance. As soon as the fold between the flap and the envelope body is gripped in the closing nip and the envelope is discharged via the closing nip, the upsetting rollers are entrained by the body of the envelope with free rotation until it is free from the upsetting rollers. Preferably, the delay of the leading part of an envelope is started after the fold between the flap and the envelope body has reached the last nip upstream of the closing nip. This prevents the envelope body from being upset whereby it may be creased or torn.

Further, the surfaces for delaying, stopping or forcing back a leading portion of an envelope need not be provided with a drive mechanism or be designed as circuitous surfaces. It is for instance possible to design the opposite surfaces as gripping surfaces of a pair of grippers on either side of the envelope transfer track. In response to the completion of a specific displacement of an envelope from the filling position, the grippers can be operated for clamping a leading portion of the envelope, causing it to deflect upstream of the grippers. Further, the grippers can be designed so that exertion of a force on those grippers against the direction of transport results in the release of an envelope retained between those grippers. In this manner, the originally leading part of an envelope can automatically be released as soon as the envelope is conveyed, via the closing nip, to the holder for filled and closed envelopes.

Another alternative possibility consists in that circuitous conveying surfaces for stopping a leading portion of an envelope are coupled to freewheel clutches so that movement of the envelope in the original direction of transport is blocked in the nip between those circuitous conveying surfaces, but movement to the closing nip in the nip between those circuitous conveying surfaces is allowed. By moving such circuitous conveying surfaces towards each other, in response to reaching a specific displacement of an envelope, until the leading part of that envelope is clamped, the displacement of the leading part of the envelope in the direction of transport can be stopped. As movement against the direction of transport, i.e. in the direction of the closing nip, is in fact allowed, the originally leading portion of the envelope can follow the rest of the envelope passing through the closing nip without this requiring a special operation.

Further, the displacement of the envelope along the envelope transfer track can be determined in many ways. Rather than by registration of the angular displacement of a conveying roller or a driving shaft, the displacements may also be determined by controlling the conveying means in such a manner that there is a specific time-path relation and by determining the time during which the envelope is conveyed. For displacing the envelope through an intended fixed distance, for instance the time taken by the conveyance along the envelope transfer track may in each case be selected so that a displacement through the intended fixed distance is obtained.

I claim:

1. An enveloping apparatus, comprising:

an envelope filling position for each time holding an envelope with an envelope body, a flap and a hinge line between said envelope body and said flap, in each case with said hinge line in a predetermined position and with said flap in a position opened relative to said envelope body, a document inserting structure comprising a document feed track with a downstream end connecting to the envelope filling position, an insertion guide for inserting documents in an envelope in the envelope filling position, a pair of pressure rollers with an interlocated closing nip at a distance from the envelope filling position and beside the envelope transfer track, upsetting means for at least delaying a leading portion of an envelope in the envelope transfer track relative to a trailing portion, comprising a pair of surfaces located opposite each other on both sides of the envelope transfer track, with an interlocated nip and means coupled to at least one of said surfaces for at least delaying, in activated condition, movement in the direction of transport of said surfaces in the region of the nip, and a control structure for controlling the document inserting structure and the envelope transfer track, adapted to determine the distance over which an envelope is moved from the envelope filling position along the envelope transfer track, and to activate the upsetting means in response to a movement of said envelope from the envelope filling position along the envelope transfer track over a fixed determined distance, independently of the sizes in the direction of transport of said envelope.

2. An apparatus according to claim 1, wherein the envelope transfer track comprises a number of driven conveying elements and the control structure is adapted to operate the envelope transfer track in a manner such that during transport of an envelope, for the conveying elements defining the envelope transfer track upstream of the closing nip, the unrolling distances each determined by the product of the angular displacement and the unrolling circumference of the relevant conveying element are always mutually equal, and to start the at least delaying of a leading portion of an envelope in response to the reaching by said conveying elements of an unrolling distance equal to said fixed distance.

3. An apparatus according to claim 1, further comprising an envelope detector along the envelope transfer track for detecting an end edge of a passing envelope directed transversely to the envelope transfer track, wherein said envelope transfer track and said control structure are adapted to detect the movement of said envelope from a fixed position prior to detection of said end edge and to determine the further movement of said envelope after detection of said end edge, in a manner such that the sum of the movements of the detected envelope before and after detection of said end edge corresponds to said fixed distance.

4. An apparatus according to claim 1, further comprising an envelope detector along the envelope transfer track for detecting an end edge of a passing envelope directed transversely to the envelope transfer track and means for feeding and registering a first value corresponding to the distance in the direction of transport between said hinge line and said end edge of said envelope, wherein said envelope transfer track and said control structure are adapted to determine the further movement of said envelope after detection of said end edge from said first value and a second value corresponding to the distance along the envelope transfer track between the envelope detector and a specific region of the envelope transfer track before the closing nip.

5. An apparatus according to claim 2, wherein the driven conveying elements which at least partly define the envelope transfer track upstream of the upsetting means are intercoupled without slip.

6. An apparatus according to claim 1, further comprising a pulse disk coupled to at least one of the conveying elements of the envelope transfer track.

7. An apparatus according to claim 1, wherein at least one of the opposite surfaces of the upsetting means is movable back and forth relative to the other one of said surfaces between a run-in position at a distance from the other one of said surfaces and an upsetting position against the other one of said surfaces.

8. An apparatus according to claim 7, wherein the surfaces of the upsetting means are designed as circuitous conveying surfaces coupled to the drive of conveying elements of the envelope transfer track upstream of the upsetting means.

9. An apparatus according to claim 1, wherein a first discharge track for discharging closed envelopes connects to said closing nip and wherein a second discharge track for discharging non-closed envelopes connects to said upsetting means.

10. A method for filling and closing an envelope substantially extending in one plane, with a flap, an envelope body and an interlocated hinge line, comprising the steps of:

holding said envelope in an envelope filling position with said hinge line in a predetermined position, wherein the flap is held in open condition relative to the envelope body, feeding at least one document to said envelope in the envelope filling position, inserting the or each document fed in said envelope in the envelope filling position, moving the filled envelope along an envelope transfer track in a direction transverse to said hinge line and substantially in the plane of said envelope, passing a leading portion of said envelope in a nip between opposite surfaces downstream of a closing nip located on the side of the envelope transfer track, at least delaying the leading portion of said envelope in response to a movement of said envelope along the envelope transfer track over a fixed distance from the envelope filling position, said distance being independent of the length of said envelope, by at least delaying said surfaces relative to trailing portions of said envelope, in a manner such that said hinge line deflects from said envelope transfer track towards said closing nip, and feeding said envelope with said leading hinge line through said closing nip beside the envelope transfer track.

11. A method according to claim 10, wherein the movement of the filled envelope along the envelope transfer track is carried out by means of successive pairs of conveying elements upstream of the closing nip, wherein during transport of said envelope along the envelope transfer track the values of the product of the angular displacement and the unrolling circumference for each of said conveying elements are always mutually equal and the at least delaying of a leading portion of said envelope is started in response to the reaching by at least a specific one of said conveying elements of a fixed angular displacement corresponding to said fixed distance for said conveying element.

12. A method according to claim 10, further comprising the steps of:

detecting an end edge of said envelope directed transversely to the envelope transfer track when passing a specific point along the envelope transfer track, determining the movement of said envelope prior to detection of said end edge, and determining the further movement of said envelope after detection of said end edge in a manner such that the sum of the movements before and after the detection of said end edge corresponds to said fixed distance.

13. A method according to claim 10, further comprising the steps of:

feeding and registering a first value corresponding to the distance in the direction of transport between said hinge line and an end edge of said envelope directed transversely to the direction of transport along the envelope transfer track, detecting said end edge when passing a specific point along the envelope transfer track, determining the further movement of said envelope after detection of said end edge from said first value and a second value corresponding to the distance along the envelope transfer track between the envelope detector and a region of the envelope transfer track before the closing nip and the at least delaying of the leading portion of the detected envelope in response to said further movement, wherein the hinge line between the flap and the envelope body in said region of the envelope transfer track before the closing nip is deflected.

* * * * *